US005529179A

United States Patent [19]

Hanson

[11] Patent Number: 5,529,179

[45] Date of Patent: Jun. 25, 1996

[54] DISPENSING LID FOR BEVERAGE CONTAINER

[76] Inventor: Claudia J. Hanson, 9233 Markland La., Sebring, Fla. 33872

[21] Appl. No.: 494,804

[22] Filed: Jun. 26, 1995

[51] Int. Cl.[6] ..... B65D 81/32

[52] U.S. Cl. ..... 206/219; 206/217; 206/459.5; 215/227; 220/521; 426/115; 426/120

[58] Field of Search ..... 206/217, 219–222, 206/459.5, 568; 215/227, 229; 220/521, 522; 426/115, 120

[56] References Cited

U.S. PATENT DOCUMENTS

| | | | |
|---|---|---|---|
| 3,326,363 | 6/1967 | Bennett et al. | 206/219 |
| 3,332,586 | 7/1967 | Amburgey | 222/480 |
| 3,743,520 | 7/1973 | Croner | 206/219 |
| 3,796,813 | 3/1974 | Kurland | 206/217 |
| 3,924,741 | 12/1975 | Kachur et al. | 206/221 |
| 4,785,931 | 11/1988 | Weir et al. | 206/222 |
| 4,810,245 | 3/1989 | Aagesen | 222/145 |
| 4,880,136 | 11/1989 | Englert | 220/253 |
| 5,035,320 | 7/1991 | Plone | 206/222 |
| 5,052,553 | 10/1991 | De Sanctis | 206/219 |
| 5,431,276 | 7/1995 | Lialin | 206/219 |

*Primary Examiner*—Jimmy G. Foster
*Attorney, Agent, or Firm*—Norman B. Rainer

[57] ABSTRACT

A dispensing lid for the circular upper rim of a beverage container is made having a flat base panel having a circular perimeter. A continuous lip downwardly directed from the perimeter is configured to embrace the rim of the container. Frangible vessels fabricated of thin plastic film are disposed within the base panel. The vessels contain condiments which are ordinarily added to popular beverages. When finger pressure is applied to the vessels, the undersides of the vessels break, thereby discharging the condiments into the beverage container.

4 Claims, 1 Drawing Sheet

DISPENSING LID FOR BEVERAGE CONTAINER

RELATED APPLICATIONS

This Application is identical to application Ser. No. 08/179,371, filed Jan. 10, 1994, abandoned.

BACKGROUND OF THE INVENTION

1. Field of the Invention

This invention concerns a lid for a beverage container, and more particularly relates to a plastic lid adapted to hold and controllably release ingredients into said container.

2. Description of the Prior Art

Beverages sold by "fast food" restaurants are generally sold in disposable or inexpensive plastic or paper containers. In order to sell such beverages quickly and at low price, the containers are filled with beverages such as coffee or tea without modifying ingredients or condiments such as sugar, synthetic sweetener, cream or lemon. Instead, it becomes the customer's chore to add whatever additional ingredients he or she desires. Often, and particularly in "take-out" service where the beverage is to be consumed away from the restaurant, the condiments are made available to the customer in individually packaged plastic containers.

Such individual condiment containers are relatively costly, and further contribute to a general litter problem when inadvertently or carelessly disposed of. The take-out beverage is often intended for the driver of a motor vehicle, and is often purchased by the driver at a drive-in serving station of the restaurant. For such driver, any manipulations required to transfer condiments to the beverage container represents a distraction of attention from his proper operation of the vehicle. Also, the motion of the vehicle or lack of a flat work surface may contribute to spillage of the beverage if the lid were to be removed.

Multi-compartmented containers have earlier been disclosed for the controlled mixing of previously separated ingredients. Specialized closure devices have also been disclosed having means for controllably releasing confined ingredients into an underlying container. Such closure devices, however, are usually of expensive construction and not intended as items to be disposed of after a single use. Furthermore, earlier ingredient-dispensing closures require two-hand operation and are of limited versatility in terms of the number or quantities of different ingredients that can be handled.

It is accordingly an object of the present invention to provide a lid for holding and dispensing ingredients into a beverage container.

It is another object of this invention to provide a lid as in the foregoing object wherein said ingredients can be dispensed in a single hand operation.

It is a further object of the present invention to provide a lid of the aforesaid nature capable of holding and dispensing several varied ingredients.

It is yet another object of this invention to provide a lid of the aforesaid nature of substantially integral construction and which does not shed component parts in the course of normal use.

It is a still further object of the present invention to provide a lid of the aforesaid nature amenable to sufficiently low cost manufacture to justify disposal following one time use.

These and other beneficial objects and advantages will be apparent from the following description.

SUMMARY OF THE INVENTION

The above and other beneficial objects and advantages are accomplished in accordance with the present invention by a lid for the circular upper rim of a beverage container, said lid comprising:

a) a substantially flat base panel of thin uniform thickness having a circular perimeter, upper and lower surfaces, and circular apertures communicating between said surfaces, b) a continuous lip downwardly directed from said perimeter as a continuous integral extension thereof and configured to engage said rim, c) frangible vessels disposed within said apertures, and fabricated of thin plastic film material, said vessels having an upper portion of spherical contour disposed above said upper surface, and a lower portion of rupturable segmented configuration extending below said lower surface as a continuous integral extension of said upper portion, whereby finger pressure applied downwardly upon said upper portion causes said lower portion to rupture, d) a latent aperture in said base panel for insertion of a drinking straw, e) a sealable aperture in said base panel for permitting emergence of a beverage from said container, and f) indicia disposed upon said upper surface adjacent said vessels for identifying the content of said vessels.

BRIEF DESCRIPTION OF THE DRAWING

For a fuller understanding of the nature and objects of the invention, reference should be had to the following detailed description taken in connection with the accompanying drawing forming a part of this specification and in which similar numerals of reference indicate corresponding parts in all the figures of the drawing.

DESCRIPTION OF THE PREFERRED EMBODIMENT

Figure 1:
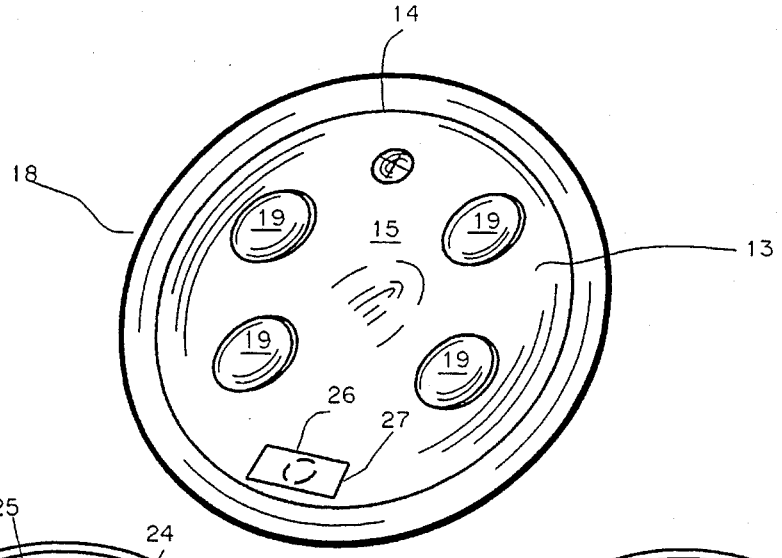
FIG. 1 is a top perspective view of an embodiment of the lid of this invention.
Figure 2:
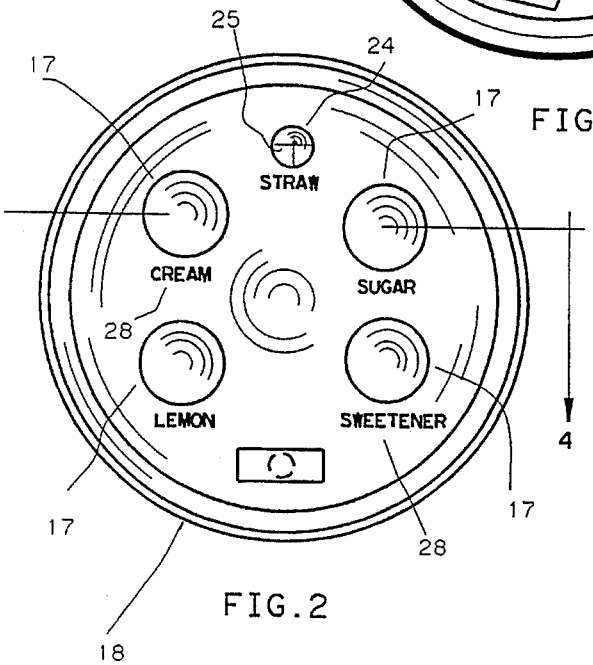
FIG. 2 is a top plan view thereof.
Figure 3:
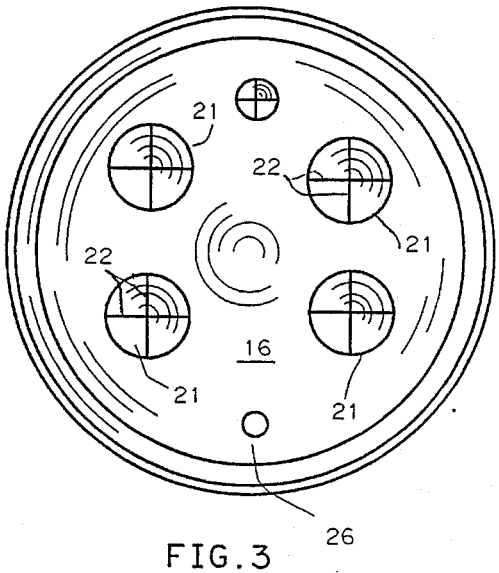
FIG. 3 is a bottom view thereof.
Figure 4:
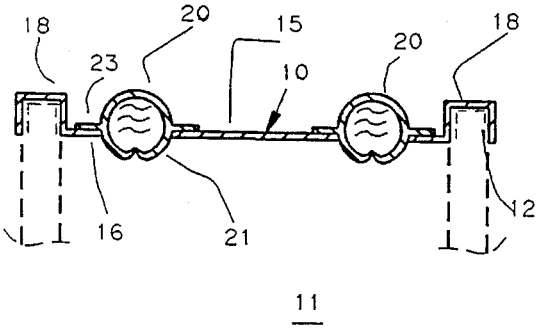
FIG. 4 is a sectional view taken in the direction of the arrows upon the line 4—4 of FIG. 2.

Referring now to FIGS. 1–4, an embodiment of the lid 10 of the present invention is shown adapted to serve as closure means for a disposable container 11 having upper circular rim The lid is comprised of substantially flat base panel 13 of uniform thickness having a circular perimeter 14 and upper and lower surfaces 15 and 16, respectively, and circular apertures 17 communicating between said upper and lower surfaces.

A continuous lip 18 of U-shaped cross-section is downwardly directed from said perimeter as a continuous integral extension of panel 13, and configured to frictionally engage rim 12 to form a liquid-impermeable seal.

The lid may be produced by a thermoforming and punching operation conducted on a single piece of thin sheet stock of a thermoplastic material such as polystyrene, polyethylene, and a terpolymer of acrylonitrile, butadiene and styrene, often referred to as ABS plastic. The thickness of the sheet stock will generally be less than one millimeter.

Frangible vessels 19 containing condiments in liquid or powder form are disposed within apertures 17. The vessels are fabricated of thin, flexible and preferably transparent film material such as plasticized polyvinylchloride, polyethylene, or equivalent plastic. The vessels have an upper portion 20 of spherical contour disposed above upper surface 15, and a lower portion 21 of rupturable segmented configuration extending below lower surface 16 as a continuous integral extension of upper portion 20. The rupturable condition of the lower portion may be achieved by way of crossed lines 22 that pre-weaken the film structure of said lower portion. The construction of said vessels is such that finger pressure, applied downwardly upon said upper portion, causes said lower portion to rupture, thereby discharging the contents of the vessel into the underlying beverage container 11.

Vessels 19 may be secured to base panel 13 by way of adhesives or thermal bonding, perhaps augmented by a skirt-like flange 23 that may extend laterally from the vessel at its midpoint.

Latent aperture 24, comprised of crossed serrations permits insertion of a drinking straw through the lid. A sealable aperture 26 sealed by adhesive strip 27 provides the user with the option of utilizing the aperture to remove liquid from the container or provide air entrance to facilitate functioning of a straw.

Figure 5:
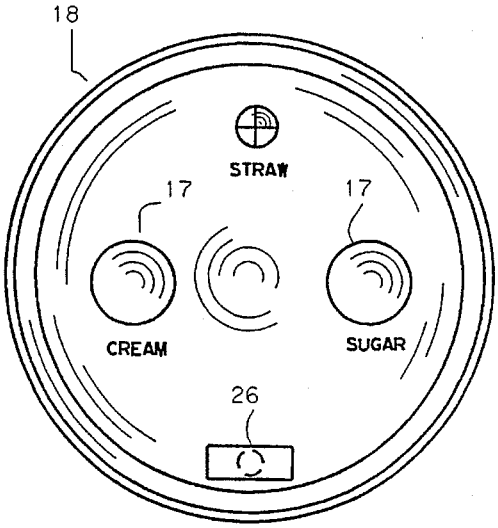
FIG. 5 is a top plan view of an alternative embodiment of the lid of this invention.

Indicia 28 are disposed upon upper surface 15 adjacent said vessels for identifying the contents of the vessel. Although four vessels 19 are exemplified in the embodiment of FIG. 1–4, greater or fewer numbers of vessels may be utilized, as shown in FIG. 5. The exact location of the vessels is not critical, but a symmetrical disposition with respect to the center of the lid is preferable. Latent aperture 24 will generally be diametrically opposed to sealable aperture 26.

While particular examples of the present invention have been shown and described, it is apparent that changes and modifications may be made therein without departing from the invention in its broadest aspects. The aim of the appended claims, therefore, is to cover all such changes and modifications as fall within the true spirit and scope of the invention.

Having thus described my invention, what is claimed is:

1. A lid for the circular upper rim of a beverage container, said lid comprising:

a) a substantially flat base panel of thin uniform thickness having a circular perimeter, upper and lower surfaces, and circular apertures communicating between said surfaces, b) a continuous lip downwardly directed from said perimeter as a continuous integral extension thereof and configured to engage said rim, c) frangible vessels disposed within said apertures, and fabricated of thin plastic film material, said vessels having an upper portion of spherical contour disposed above said upper surface, and a lower portion of rupturable segmented configuration extending below said lower surface as a continuous integral extension of said upper portion, whereby finger pressure applied downwardly upon said upper portion causes said lower portion to rupture, d) a latent aperture in said base panel for insertion of a drinking straw, e) a sealable aperture in said base panel for permitting emergence of a beverage from said container, and f) indicia disposed upon said upper surface adjacent said vessels for identifying the content of said vessels.

2. The lid of claim 1 wherein said vessels are fabricated of thin transparent plastic flim material.

3. The lid of claim 2 wherein the rupturable condition of the lower portions of said vessel is achieved by way of crossed lines that pre-weaken said film material.

4. The lid of claim 2 wherein said vessels have a skirt-like flange adapted to be bonded to said upper surface.

* * * * *